US005643151A

United States Patent [19]

Naimo

[11] Patent Number: 5,643,151

[45] Date of Patent: Jul. 1, 1997

[54] WEIGHT RELEASE MECHANISM FOR WEIGHT-LIFTING EQUIPMENT

[76] Inventor: Salvatore G. Naimo, 20 Private Rd., Edison, N.J. 08817

[21] Appl. No.: 394,823

[22] Filed: Feb. 27, 1995

[51] Int. Cl.[6] ..... A63B 21/06

[52] U.S. Cl. ..... 482/98; 482/93

[58] Field of Search ..... 482/93, 94, 97–103, 482/908

[56] References Cited

U.S. PATENT DOCUMENTS 4,746,113 5/1988 Kissel .
5,350,344 9/1994 Kissel .

FOREIGN PATENT DOCUMENTS 1258447 9/1986 U.S.S.R. ..... 482/93
1389789 4/1988 U.S.S.R. ..... 482/99

*Primary Examiner*—Richard J. Apley
*Assistant Examiner*—John Mulcahy
*Attorney, Agent, or Firm*—Lerner, David, Littenberg, Krumholz & Mentlik

[57] ABSTRACT

An exercise machine including a weight stack composed of a plurality of separate weights; a lifting bar disposed for movement within the wieght stack; a plurality of pins extendable from within the lifting bar for removably securing a portion of the weight stack to the lifting bar and retractable within the lifting bar, whereby the total weight carried by the lifting bar is determined by the portion of the weight stack removably secured to the lifting bar by plurality of pins, wherein the extension of the plurality of pins from within the lifting bar secures the portion of the weight stack to the lifting bar and the retraction of the plurality of pins within the lifting bar removes the portion of the weight stack from the lifting bar; a plurality of springs for retracting the pins within the lifting bar; a key for extending one or more of the pins from the lifting bar; a cable connected to the key; a reel for biasing the cable and key in one direction; and a foot-pedal for pulling the cable and key in the other direction whereby movement of the key in one direction extends the pins to add weights to the stack and movement in the other direction allows the pins to retract to drop weights from the stack.

12 Claims, 5 Drawing Sheets

WEIGHT RELEASE MECHANISM FOR WEIGHT-LIFTING EQUIPMENT

FIELD OF THE INVENTION

The present invention relates to lift rods for weight-lifting machines that support metal weight stacks and use pins to removably secure the desired weight. More particularly, the lift rods of the present invention permit the manual addition and release of weights, allowing users of the equipment to add weights without changing their position and to release weight without relaxing their muscles.

BACKGROUND OF THE INVENTION

Today, bodybuilding has become one of the most popular sports. Because not everyone has the same goal when working out, there are many different programs to follow. The two major programs are for building mass and/or definition.

The program known as "pyramiding" builds both mass and definition in combination. By using this method with proper daily eating and workout habits, the optimum combination of results is obtained. A "pyramiding" workout should consist of lifting heavy weights for mass, light weights for definition and a combination of the two, without relaxing the muscles, for the fastest and best results. The procedure should start with the heaviest possible weight and work down.

Bodybuilding training combines overload and volume to get its effect. The action of individual muscle fibers, on the other hand, is quite simple—a fiber contracts when stimulated and relaxes when the stimulation ceases. Contraction of an entire muscle is the result of the contraction of many tiny, individual muscle fibers. Fibers contract on an all or nothing basis. However, after a series of contractions, a fiber begins to get tired and the amount of effort it can generate diminishes when lifting a maximum amount of weight at one time. Only a fraction of the total amount of fiber in the muscles is actually used.

With only one or two repetitions of a lift, the body never gets a chance to recruit fresh fibers to replace the weak and tired ones. Weight lifters learn to recruit an unusual amount of fibers in one maximal lift, but they put such an immense strain on those fibers that the body adapts and protects itself by making those fibers bigger and thicker. This is called hypertrophy. But, no matter how many fibers the weight lifter involves in one maximum lift, he still used less than if he lifted less weight and did more repetitions. Therefore, he only trains and strengthens part of the muscle's structure.

With pyramiding, the heaviest weight is used first, followed by more repetition at lower weights. Weight stack-based lifting equipment is preferred for a pyramiding workout because of the relative quickness with which weight may be reduced. Nevertheless, in the time it takes to lower the weight on such machines, the muscles will relax and the failure process will have to be started all over again.

U.S. Pat. Nos. 4,746,113 and 5,350,344 describe weight-lifting machines in which weight may be released by pushing a button on the lifting handle. However, these patents describe a complex device in which a computer-operated control mechanism for changing weights must be attached to the exterior of the weight set. Such a device is costly, maintenance-intensive and occupies space needed for other purposes. There remains a need for a simplified means by which weight may be released from a weight stack without lowering the weights and relaxing the lifting muscles. A means by which weights can be similarly added to a weight stack would also be convenient.

SUMMARY OF THE INVENTION

These needs are met by the present invention. In accordance with the present invention there is provided an exercise machine including:

- a weight stack composed of a plurality of separate weights;
- a lift bar disposed for movement within the stack;
- pin means extending from within the lift bar for removably securing a portion of the weight stack to the lift bar and retractable within the lift bar, whereby the total weight carried by the lift bar is determined by the portion of the weight stack removably secured to the lift bar by the pin means, wherein the extension of the pin means from within the lift bar secures the portion of the weight stack to the lift bar and the retraction of the pin means within the lift bar removes the portion of the weight stack from the lift bar; and
- means for extending the pin means from and retracting the pin means within the lift bar.

The present invention includes exercise machines in which weight stacks are disposed horizontally, vertically, or any angle in between. The present invention also does not depend upon the size of the weight stack, which may range between 100 and 300 pounds.

While the means for extending and retracting the pin means may be electrically operated and/or controlled, preferred devices in accordance with the present invention extend and retract the pin means from within the lift bar by purely mechanical means. The lift bar, pin means and means for extending and retracting the pin means from within the lift bar operate as a single component that is interchangeable with conventional lift bars and pins used with the weight stacks of commercially available exercise machines. Thus, existing exercise machines may be retrofitted to accommodate the device of the present invention without attaching multi-control devices to the exterior of the exercise machine.

BRIEF DESCRIPTION OF THE DRAWINGS

A more complete appreciation of the invention and many more other intended advantages can be readily attained by reference to the following detailed description when considered in connection with the following drawings, wherein.

It should be noted that the drawings are not necessarily to scale, but that certain elements have been expanded to show more clearly the various aspects of the present invention and their advantages.

DETAILED DESCRIPTION OF THE PREFERRED EMBODIMENT

Figure 1:
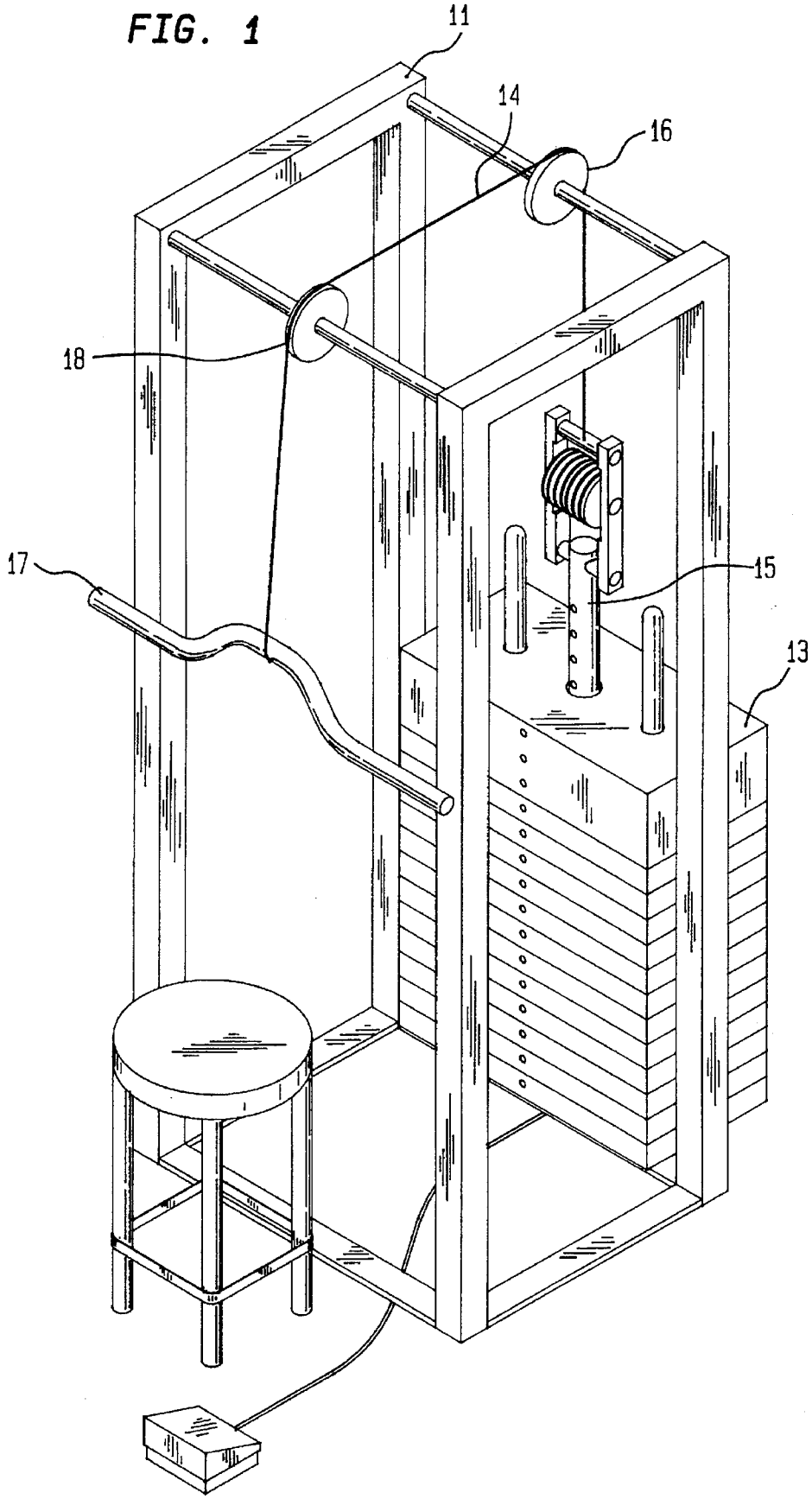
FIG. 1 is a perspective view illustrating the use of the device of the present invention in combination with a conventional weight training machine.

The device of the present invention is shown in FIG. 1 as part of weight-lifting machine 11 in which weight stack 13 is carried by lifting bar 15 which is mechanically secured by a cable 14 fitted over a pair of pulleys 16 and 18 to a handle bar 17. The user pulls downwardly on the handlebar 17 to lift the weight stack 13 upwardly. Raising the handlebar 17 consequently lowers the weight stack 13. Any conventional means for controlling the path of the weight stack may be included in the present invention, such as guide rails parallel to the lifting bar 15.

Although the weight machine is shown as a cable-operated device, the present invention is generally applicable to any weight training machine having a stack of weights securable by a pin to a lifting bar, of which many types are known in the art. For clarity of illustration, the frame of the weight-lifting machine is not depicted.

Thus, the combination of the weight stack 13 and lifting bar 15 can be oriented vertically, horizontally, or any angle in between. The weight stack may consist of more or less than the amount of weight that is depicted in FIG. 1. Lifting bar 15 may be longer or shorter than depicted, depending upon the size of the weight stack 13 supported by lifting bar 15.

Figure 2A:
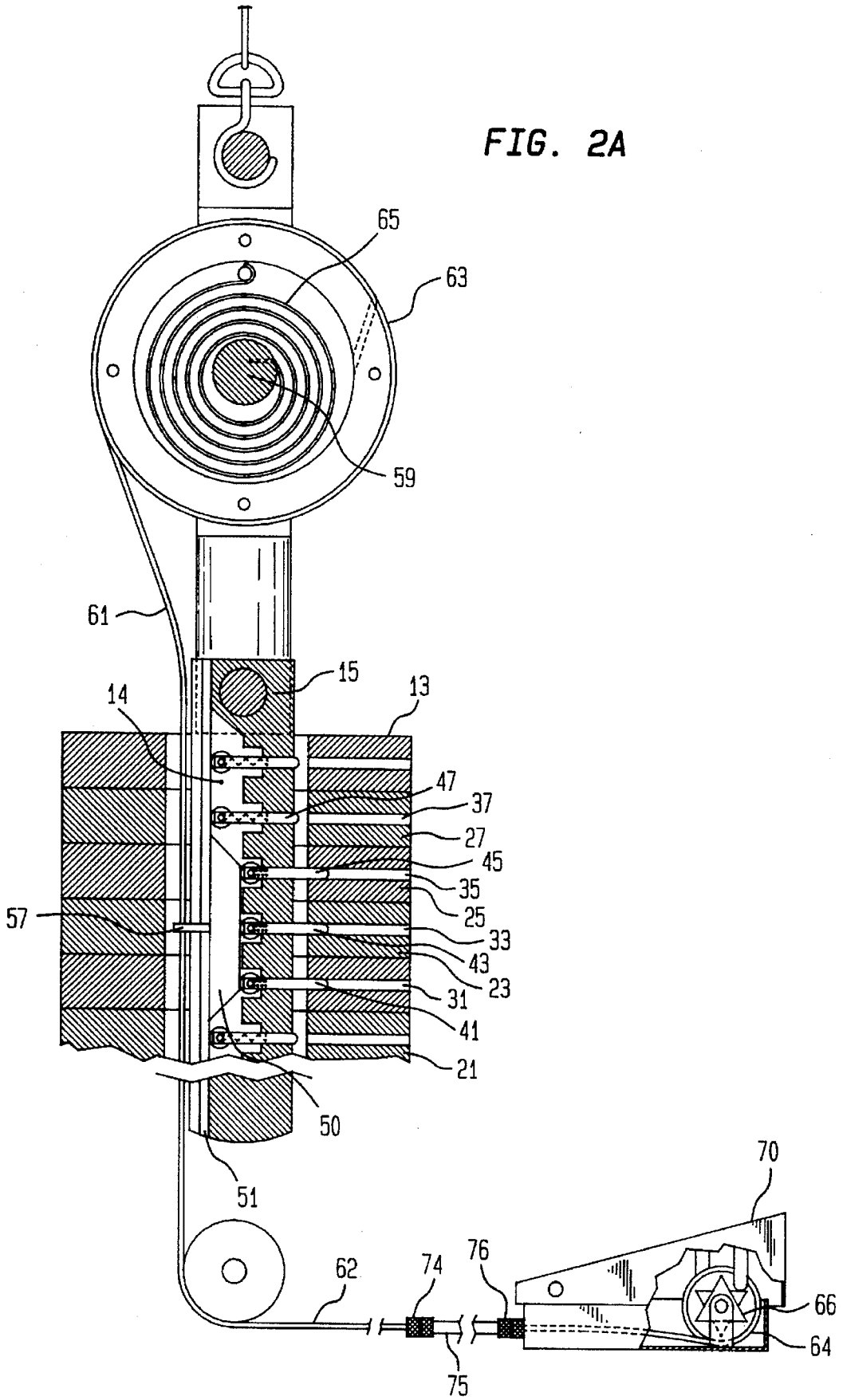
FIG. 2A is a side elevational view of a stack of weights incorporating the device of the present invention.
Figure 2B:
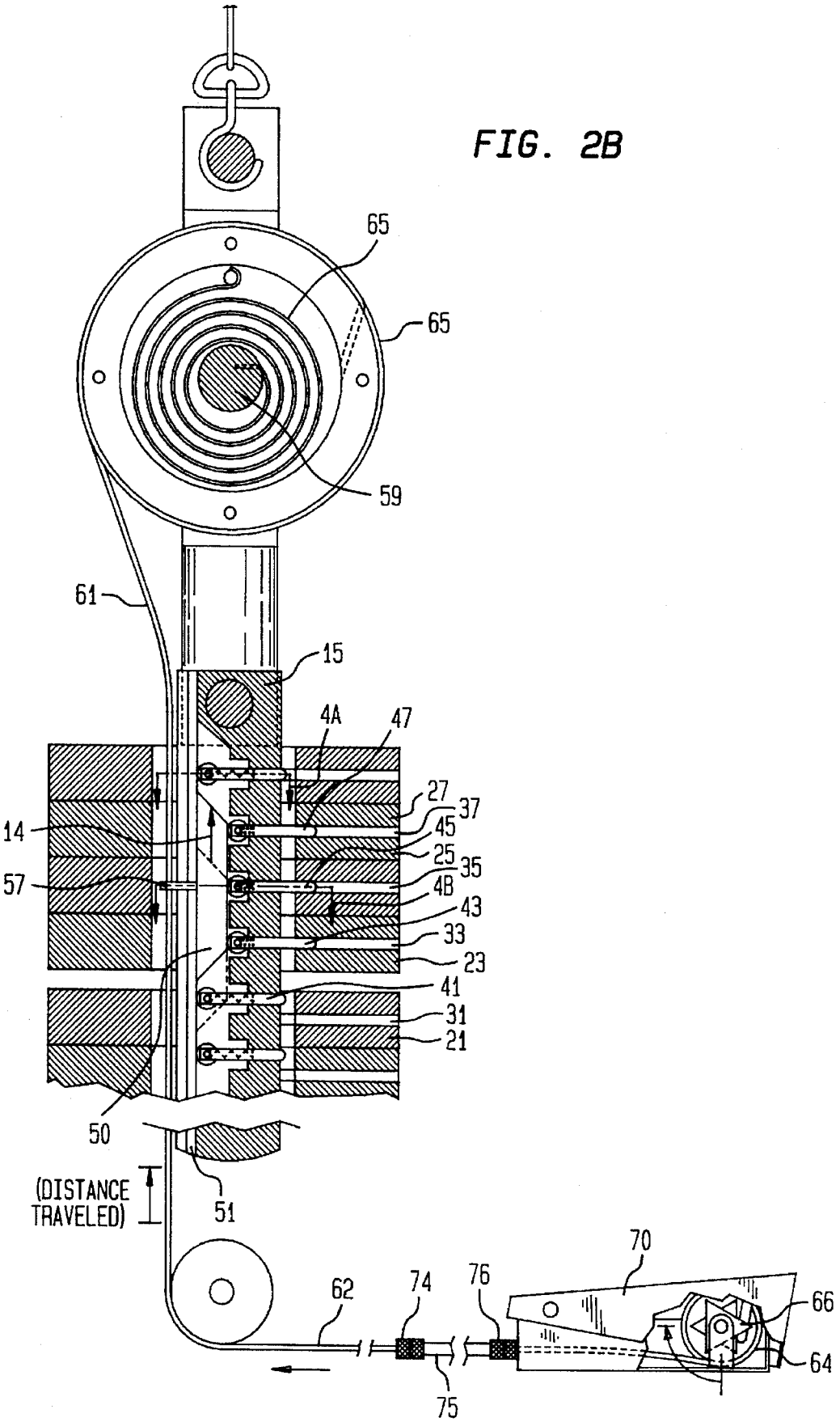
FIG. 2B is a side elevational view of a stack of weights incorporating the device of the present invention, with one weight dropped from the stack by withdrawal of a supporting pin means.

As shown in FIGS. 2A and 2B, weight stack 13 consists of individual weights 21, 23, 25 and 27, each of which is secured to lifting bar 15 by the insertion into the respective openings 31, 33, 35 and 37 of each individual weight of pin means labelled 41, 43, 45 and 47, respectively. Lifting bar 15 is hollow to permit the retraction of pin means 41, 43, 45 and 47 into channel 14. Extension of pin means 41, 43, 45 and 47 is accomplished by key 50 from within lifting bar 15.

Each individual weight will support all individual weights resting on it. The weight to be initially lifted is selected by securing to the lifting bar 15 at a minimum, the individual weight providing a base for the weight stack having the desired weight to be lifted.

The weight to-be initially lifted is selected by raising or lowering key 50 within channel 14 of lifting bar 15 with cables 62 and 64, respectively. Key 50 is positioned opposite the individual weights that are to provide a support base for the weight stack having the desired weight to be lifted.

Figure 4A:
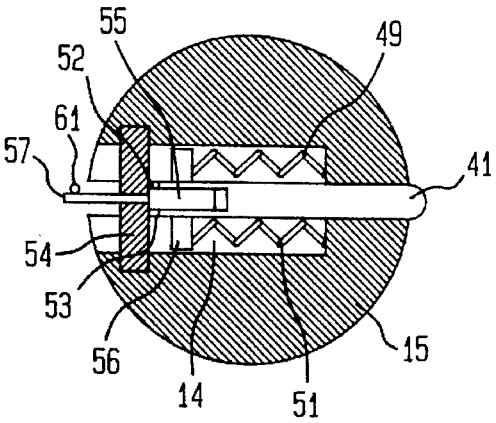
FIG. 4A is a top elevational view of the lifting bar device of the present invention, depicting a withdrawn pin means.
Figure 4B:
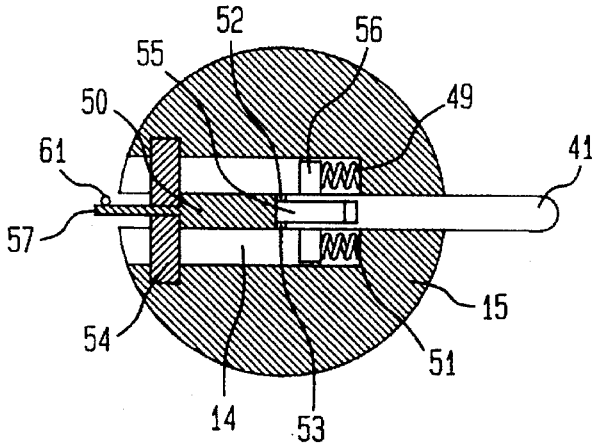
FIG. 4B is a top elevational view of the lifting bar device of the present invention, depicting an extended pin means.

Pin 41 supporting individual weight 21 is shown in detail in FIGS. 4A and 4B. Arms 52 and 53 of pin 41 define channel 54 containing wheel 55. Roller 56 passes through slots in wheel 55 and arms 52 and 53 to function as an axis for the rotation of wheel 55. Lifting bar 15 thus contains a row of wheel-backed pins that provide a surface against which key 50 is moved up and down by cables 62 and 64 in channel 14 to contact the pins, thereby extending them from the lifting bar. Longitudinal strip 54 closes the back of channel 14 to retain key 50 and the spring-loaded pin, wheel and roller assemblies within lifting bar 15. Strip 51 contains a longitudinal slit (not shown) running the entire length of lifting bar 15 through which key tooth 57 extends. The cables raising and lowering key 50 within channel 14 are attached to key 50 by this tooth. The longitudinal slit is dimensioned to permit key tooth 57 to be raised and lowered within the slit, but is at the same time sufficiently narrow to retain the key.

The extension of pin 41 by key 50 is depicted in FIG. 4B. Contact of key 50 with wheel 55 extends the pin means from within the lifting bar 15, compressing springs 49 and 51 against roller 56. In FIG. 4A, key 50 has been lowered below the plane of pin 41 and is no longer in contact with wheel 55. The compression of springs 49 and 51 is released, thereby returning pin means 41 to the retracted position within lifting bar 15.

The release of individual weight 21 from the weight stack 13 is shown in FIGS. 2A and 2B. In FIG. 2A, key 50 contacts three pin means 41, 43 and 45. Three individual weights 21, 23 and 25 are secured by the respective extended pins and serve as the support base for weight stack 13, so that the weight stack is adequately secured to the lifting bar 15.

In FIG. 2B, key 50 is raised so that it no longer contacts pin means 41, but instead contacts pin means 43, 45 and 47. The compression of springs 49 and 51 against pin roller 56 is released, retracting pin means 41 from opening 31, thereby releasing individual weight 21 from the weight stack 13. Pin means 47 is now extended by key 50 from within lifting bar 15 into the opening 37 of individual weight 27, securing the individual weight 27 to the lifting bar with individual weights 23 and 25, which now serve as the base for weight stack 13.

Figure 3:
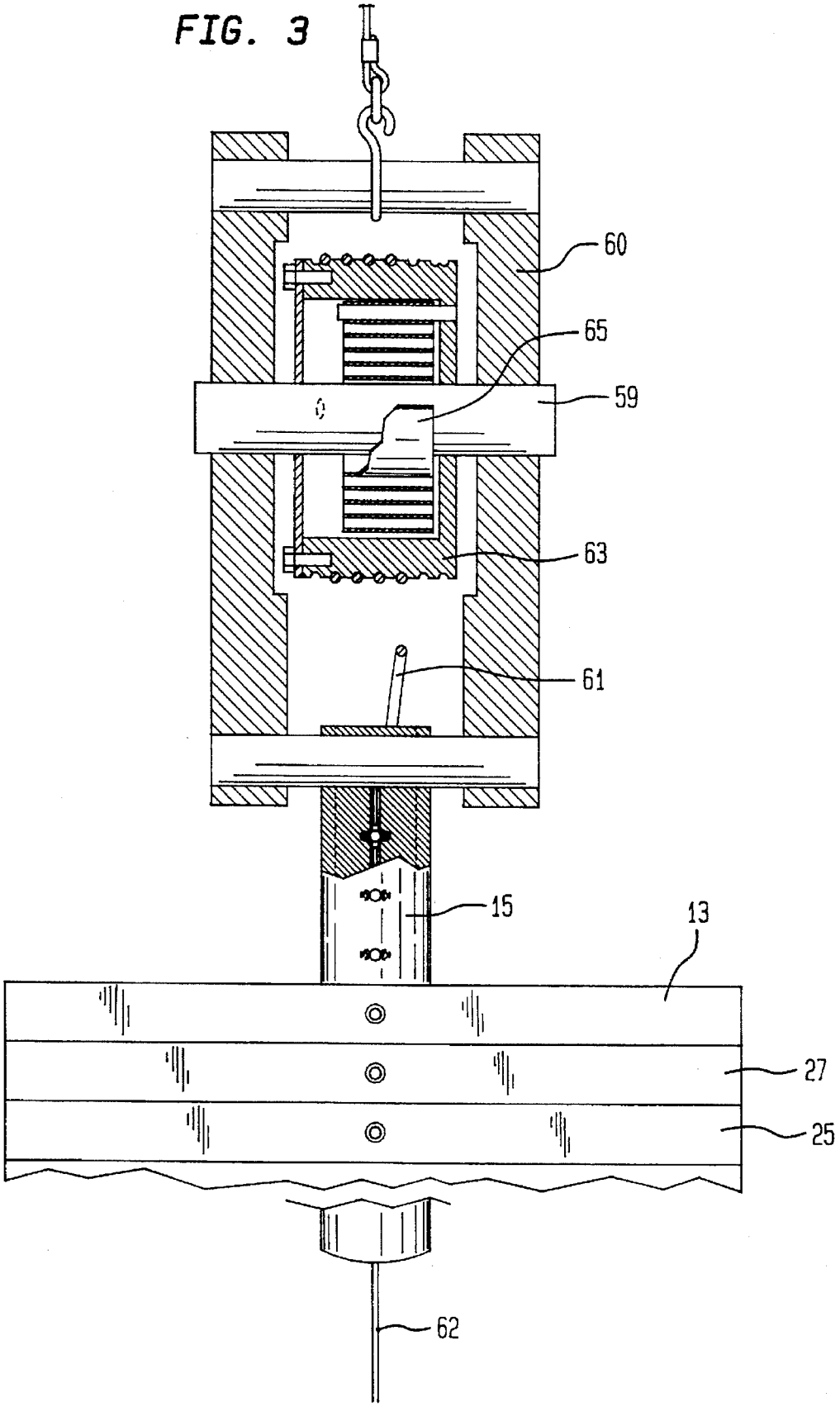
FIG. 3 is a front elevational view of a stack of weights incorporating the device of the present invention.

Individual weights may thus be sequentially released from the weight stack 13 by repeatedly moving key 50, which, as shown in FIGS. 2A and 2B, is moved by cable 61 wound on reel 63. Self-winding tension for reel 63 is provided by spring 65. As shown in FIG. 3, reel 63 spins freely in housing 60 on axle 59 mounted on lifting bar 15. Spring 65 is tensioned by being secured on one end to axle 59 and on the other end to the interior of reel 63 (see FIGS. 2A and 2B).

The retraction of key 50 by cable 61 is limited by cable 62 wound on reel 64. Cam 66, activated by pedal 70, releases a length of cable 62 corresponding to the distance by which key 50 must be raised to release one weight. Self-winding reel 63 takes up the cable slack released by reel 64, thereby raising key 50.

Figure 5A:
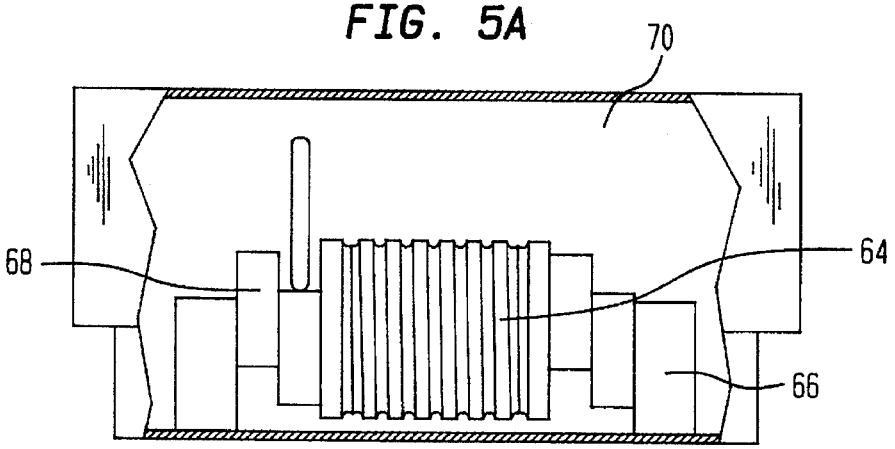
FIG. 5A is a front elevational view of a pedal means for extending and withdrawing the pin means of the device of the present invention.
Figure 5B:
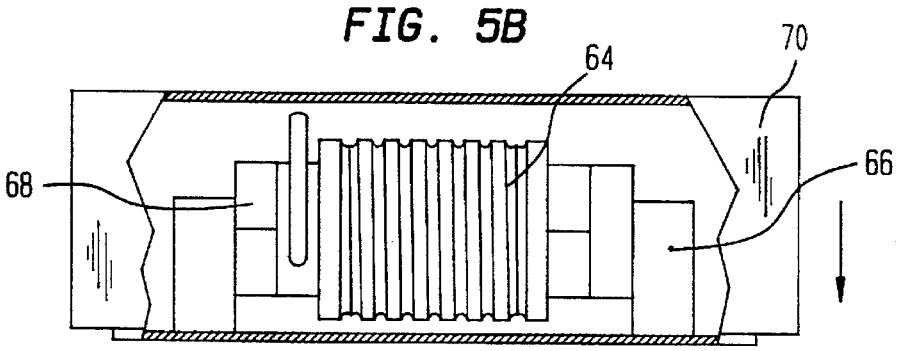
FIG. 5B is a front elevational view of a pedal means for extending and withdrawing the pin means of the device of the present invention in which the pedal means is depressed.

To add individual weights to the weight stack the process is reversed by repeatedly moving key 50 in the opposite direction. As shown in FIG. 5A, the direction of reel 64 of pedal 70 is reversed by cam 68. Switches on pedal 70 (not shown) disengage cam 66 and engage cam 68 from pedal 70. As pedal 70 is depressed in FIG. 5B, a length of cable 62 is wound onto reel 64, corresponding to the distance by which key 50 must be moved to release one weight. The winding of cable 62 pulls on key 50 and cable 61 so that a corresponding length of cable 61 is unwound from reel 63, thereby moving, key 50. It should be noted that essentially any conventional pedal-operated mechanism may be utilized to operate reel 64 in opposing directions.

The length of cable 62 between lifting bar 15 and pedal 70 must be sufficient to allow full extension of lifting bar 15, and is therefore longer than the distance between lifting bar 15 and pedal 70 when lifting bar 15 is at rest. Cable 62 is thus situated within sheath 75 between tension adjusting means 74 and 76, so that the excess of cable 62 present when lifting bar 15 is at rest, does not result in the retraction of cable 61 by reel 63 and the raising of key 50 to take up the excess of cable 62, thereby releasing weights. The combination of sheath 75 and cable 62 moves as lifting bar 15 is raised and lowered, without the movement of cable 62 within sheath 75 or lifting bar 15.

A take-up reel may optionally be provided that unwinds sheath 75 containing cable 62 as lifting bar 15 is raised and winds sheath 75 back in as the lifting bar is lowered. Sheath 75 thus permits cable 62 to be wound and unwound independently of the movement of lifting bar 15. A similar arrangement is not required for cable 61 because reel 63, together with cable 61, moves up and down with lifting bar 15.

Depending upon the size of the weight stack to be lifted, the size of key 50 may be selected to contact from one up to four pins, and more if necessary. The heavier the weight stack, the more pins that should be contacted in order to provide adequate support for the weight to be lifted.

The top individual weight is secured to the lifting bar 15 to prevent the lifting bar from floating within the weight stack 13. The thickness of the top weight is preferably equivalent to the combined thickness of the total number of individual weights engaged by key 50. However, the material of the top weight is selected so that it weighs the same as a single one of the other individual weights.

For example, if key 50 engages three individual weights, the top weight will have the thickness of three of the other weights. The other weights will be made of steel or iron, while the top weight will be made of aluminum, which is of about one-third lighter density.

Alternative means by which individual weights may be released from weight stack 13 are also contemplated. For example, the winding and unwinding of reels 63 and 64 may be controlled by an electrically-powered servo-mechanism operated by switches on pedal 70. Alternatively, the reels 63 and 64 and cables 61 and 62 may be replaced by a control rod controlled by an electrically-powered servo-mechanism operated to add or release weights by a handlebar-mounted switch. A third alternative utilizes individual solenoids to extend and retract each pin means from within the lifting bar. A control circuit operated by a pedal-mounted switch regulates the solenoids to add or release weights from the weight stack.

The present invention thus provides a simple mechanism by which weight may be released from a weight stack of an exercise machine while the stack is being lifted. This invention also permits a machine user to change weights prior to or after lifting without leaving their lifting position. By incorporating the weight-changing mechanism within a hollow lifting bar, a device is provided that may be readily retrofitted to existing exercise machines and weight-lifting equipment.

The foregoing description of the preferred embodiment should be taken as illustrating, rather than as limiting, the present invention as defined by the claims. As will be readily appreciated, numerous variations and combinations of the features set forth above can be utilized without departing from the present invention as set forth in the claims. Such variations are not regarded as a departure from the spirit and scope of the invention and all such modifications are intended to be included within the scope of the following claims.

What is claimed is:

1. An exercise machine comprising:

a weight stack composed of a plurality of separate weights;

a lifting bar disposed for movement within said weight stack;

a plurality of pin means extendible from within said lifting bar for removably securing a portion of said weight stack to said lifting bar and retractable within said lifting bar, wherein each pin means corresponds to one of said separate weights of said weight stack, whereby the total weight carded by the lifting bar is determined by the portion of said weight stack removably secured to said lifting bar by said pin means, wherein the extension of a pin means from within said lifting bar secures said corresponding separate weight of said weight stack to said lifting bar and the retraction of said pin means within said lifting bar remove said corresponding separate weight from said lifting bar;

key means within said lifting bar for extending and retracting one or more of said pin means from within said lifting bar; and means for moving said key means within said lifting bar mechanically operated with a hand-control or a foot-pedal, thereby contacting said key means with one or more of said pin means to sequentially add or remove said separate weights from said weight stack, wherein said hand-control or foot-pedal is capable of being operated to move said key means when said weight stack is being lifted.

2. The exercise machine of claim 1, wherein said weight stack is vertically disposed.

3. The exercise machine of claim 1, wherein said weight stack is disposed at an angle to the vertical plane.

4. The exercise machine of claim 1, wherein said lifting bar is mechanically secured to a handlebar, whereby movement of said handlebar by a user of said exercise machine moves said lifting bar within said weight stack.

5. The exercise machine of claim 4, wherein said lifting bar is mechanically secured to said handlebar by a cable and pulley system.

6. The exercise machine of claim 1, wherein said lifting bar includes a plurality of pin means corresponding to each of said separate weights of said weight stack.

7. The exercise machine of claim 1, wherein said means for extending said pin means extends a plurality of pin means securing a corresponding number of said separate weights.

8. The exercise machine of claim 1, wherein said means for moving said key means within said lifting bar comprises:

cable means within said lifting bar for moving said key means into contact with one or more of said pin means;

reel means on which said cable means is wound, so that the winding and unwinding of said cable means on said reel means moves said cable means within said lifting bar, thereby contacting said key means with one or more of said pin means; and means for winding and unwinding said cable means on said reel means, mechanically operated with said hand-control or foot-pedal.

9. An exercise machine comprising:

a weight stack composed of a plurality of separate weights;

a lifting bar disposed for movement within said stack;

a plurality of pin means extendible from within said lifting bar for removably securing a portion of said weight stack to said lifting bar and retractable within said lifting bar, wherein each pin means corresponds to a separate weight of said weight stack, whereby the total weight carried by the lifting bar is determined by the portion of said weight stack removably secured to said lifting bar by said pin means, wherein the extension of a pin means from within said lifting bar secures said corresponding separate weight of said weight stack to said lifting bar and the retraction of said pin means within said lifting bar removes said separate weight from said lifting bar;

key means within said lifting bar for extending and retracting one or more of said pin means from within said lifting bar, so that said separate weights of said weight stack may be changed;

cable means within said lifting bar for moving said key means into contact with one or more of said pin means;

reel means on which said cable means is wound, so that the winding and unwinding of said cable means on said reel means moves said cable means within said lifting bar, thereby contacting said key means with one or more of said pin means; and means for winding and unwinding said cable means on said reel means mechanically operated with a hand-control or a foot-pedal, thereby sequentially adding or removing said separate weights from said weight stack, wherein said hand-control or foot-pedal is capable of being operated to move said key means when said weight stack is being lifted.

10. A hollow-body lifting bar disposable for movement within a weight stack composed of a plurality of separate weights, said lifting bar comprising:

a plurality of pin means extendible from within said lifting bar for removably securing a portion of said weight stack to said lifting bar and retractable within said lifting bar, wherein each pin means corresponds to one of said separate weights of said weight stack, whereby the total weight carded by the lifting bar is determined by the portion of said weight stack removably secured to said lifting bar by said pin means, wherein the extension of a pin means from within said lifting bar secures said corresponding separate weight of said weight stack to said lifting bar and the retraction of said pin means within said lifting bar removes said separate weight from said lifting bar;

key means within said lifting bar for extending and retracting one or more of said pin means from within said lifting bar; and means for moving said key means within said lifting bar, mechanically operated with a hand-control or a foot-pedal, thereby contacting said key means with one or more of said pin means to sequentially add or remove said separate weights from said weight stack, wherein said hand-control or foot-pedal is capable being operated to move said key means when said weight stack is being lifted.

11. The lifting bar of claim 10, wherein said means for moving said key means within said lifting bar comprises:

cable means within said lifting bar for moving said key means into contact with one or more of said pin means;

reel means on which said cable means is wound, so that the winding and unwinding of said cable means on said reel means moves said cable means within said lifting bar, thereby contacting said key means with one or more of said pin means; and means for winding and unwinding said cable means on said reel means, mechanically operated with said hand-control or a foot-pedal.

12. A hollow body lifting bar disposable for a movement within a weight stack composed of a plurality of separate weights, said lifting bar comprising:

a plurality of pin means extendible from within said lifting bar for removably securing a portion of said weight stack to said lifting bar and retractable within said lifting bar, wherein each pin means corresponds to one of said separate weights of said weight stack, whereby the total weight carried by the lifting bar is determined by the portion of said weight stack removably secured to said lifting bar by said pin means, wherein the extension of a pin means from within said lifting bar secures said corresponding separate weight of said weight stack to said lifting bar and the retraction of said pin means within said lifting bar removes said separate weight from said lifting bar;

key means within said lifting bar for extending and retracting one or more of said pin means from within said lifting bar;

cable means within said lifting bar for moving said key means into contact with one or more of said pin means;

reel means on which said cable means is wound, so that the winding and unwinding of said cable means on said reel means moves said cable means within said lifting bar, thereby contacting said key means with one or more of said pin means; and means for winding and unwinding said cable means on said reel means mechanically operated with a hand-control or a foot-pedal, thereby sequentially adding or removing said separate weights from said weight stack, wherein said hand-control or foot-pedal is capable of being operated to move said key means when said weight stack is being lifted.

* * * * *

UNITED STATES PATENT AND TRADEMARK OFFICE
CERTIFICATE OF CORRECTION

PATENT NO. : 5,643,151
DATED : July 1, 1997
INVENTOR(S) : Naimo

It is certified that error appears in the above-identified patent and that said Letters Patent is hereby corrected as shown below:

On the cover page, under "ABSTRACT", line 8, "secured to the lifting bar by plurality" should read --secured to the lifting bar by the plurality--.

Column 3, line 45, "to-be" should read --to be--.

Column 4, line 40, after "weight stack" insert --,--

Column 4, line 50, after "moving" delete --,--.

Column 7, line 27, claim 10, "carded" should read --carried--.

Column 7, line 44, claim 10, "capable being" should read --capable of being--.

Signed and Sealed this

Eleventh Day of November, 1997

*Attest:*

Bruce Lehman

BRUCE LEHMAN

*Attesting Officer*

*Commissioner of Patents and Trademarks*